US006726266B2

(12) United States Patent
May

(10) Patent No.: US 6,726,266 B2
(45) Date of Patent: Apr. 27, 2004

(54) INDOOR FLOWER WATERING RACK

(76) Inventor: W. Burke May, 4 Hidden Hills Dr., Greenville, SC (US) 29605

( * ) Notice: Subject to any disclaimer, the term of this patent is extended or adjusted under 35 U.S.C. 154(b) by 20 days.

(21) Appl. No.: 10/201,374

(22) Filed: Jul. 23, 2002

(65) Prior Publication Data

US 2004/0017090 A1 Jan. 29, 2004

(51) Int. Cl.[7] ..... A45F 5/13; A45F 7/00

(52) U.S. Cl. ..... 294/144; 294/168; 211/85.23

(58) Field of Search ..... 294/32, 143, 144, 294/168, 172; 211/85.23, 88.03, 119.009, 119.011, 127.1; 47/39; 119/162

(56) References Cited

U.S. PATENT DOCUMENTS

| | | | | | |
|---|---|---|---|---|---|
| 2,053,594 | A | * | 9/1936 | Albert | 119/162 |
| 2,315,750 | A | * | 4/1943 | Wakefield | 68/205 D |
| 2,369,728 | A | * | 2/1945 | Farkas | 294/168 |
| 2,752,080 | A | * | 6/1956 | Lawlor et al. | 294/143 |
| 2,903,140 | A | * | 9/1959 | Langevin | 211/119.009 |
| 4,133,466 | A | * | 1/1979 | Rosen | 294/144 |
| 4,174,589 | A | | 11/1979 | Daharsh | |
| 4,335,540 | A | | 6/1982 | Allen | |
| 4,932,084 | A | | 6/1990 | Hanson | |
| 5,224,293 | A | | 7/1993 | Sarb | |
| 5,409,510 | A | | 4/1995 | Houweling | |
| 5,782,368 | A | | 7/1998 | Roberge | |
| 5,826,375 | A | | 10/1998 | Black | |
| 5,921,410 | A | * | 7/1999 | Emery et al. | 211/88.01 |
| 6,341,704 | B1 | * | 1/2002 | Michel, Jr. | 211/181.1 |

* cited by examiner

*Primary Examiner*—Dean J. Kramer
(74) *Attorney, Agent, or Firm*—Dale J. Ream

(57) ABSTRACT

An indoor flower watering rack includes a support rack having frame members and a plurality of laterally spaced apart support members extending longitudinally therebetween. First and second handle members are slidably coupled to the support rack and are selectively movable relative to respective frame members. First and second clamp members are attached to respective handle members for corresponding movement therewith. The clamp members are configured so as to sandwich a toilet rim therebetween upon inward clamping movement of the handle members. A plurality of legs depend from the support rack for alternatively supporting the rack upon a support surface. Therefore, the watering rack may be carried to a desired location and supported atop a toilet or upon a support surface.

17 Claims, 6 Drawing Sheets

INDOOR FLOWER WATERING RACK

BACKGROUND OF THE INVENTION

The present invention relates generally to plant watering devices and, more particularly, to an indoor flower watering rack which may be carried by handles and selectively clamped atop a toilet bowl or supported in a bathtub or sink.

Watering houseplants is often a messy task in that water may overflow the flower pot saucer or deflect off of the plant's leaves. Providing too little water so as to avoid making a mess is also disadvantageous in that the plant is deprived of adequate water.

Therefore, it is desirable to have an indoor flower watering rack that may be mounted atop a toilet bowl or positioned in a bathtub or sink such that any excess water or dirt is easily disposed of. Further, it is desirable to have an indoor plant watering rack having handles for convenient carrying of the rack. In addition, it is desirable to have an indoor watering rack having adjustable clamps for mounting to a toilet rim and legs for supporting the rack in a bathtub.

SUMMARY OF THE INVENTION

An indoor flower watering rack includes a support rack having spaced apart support members for supporting a houseplant thereon and which allows water to drain therebetween. The indoor flower watering rack further includes a pair of handle members connected to opposite ends of the support rack such that the watering rack may be carried to a desired location for use. Clamp members are connected to the handle members and are positioned beneath the support rack. The handle members are slidably coupled to the support rack and are selectively movable in inward and outward directions. The handle members may be held in selected positions with removable fasteners. Therefore, when the support rack is positioned atop a toilet bowl rim and the handle members are moved inwardly, the clamp members may sandwich the toilet bowl therebetween in a clamp fit relationship. A houseplant may be situated atop the support members of the support rack and watered, any excess water or dirt displacement being deposited into the toilet for easy disposal. Alternatively, the indoor flower watering rack may be positioned upon the surface of a bathtub or sink, the support rack having a plurality of support legs.

Therefore, a general object of this invention is to provide an indoor flower watering rack for watering houseplants over a toilet or sink for easy disposal of excess water.

Another object of this invention is to provide a watering rack, as aforesaid, having handles for carrying the rack to a desired location.

Still another object of this invention is to provide a watering rack, as aforesaid, having a pair of clamp members for clamping the support rack atop a toilet bowl rim.

Yet another object of this invention is to provide a watering rack, as aforesaid, having legs for supporting the support rack upon a bathtub or sink surface.

A further object of this invention is to provide a watering rack, as aforesaid, having an accessory box coupled to the support rack for holding gardening accessories.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
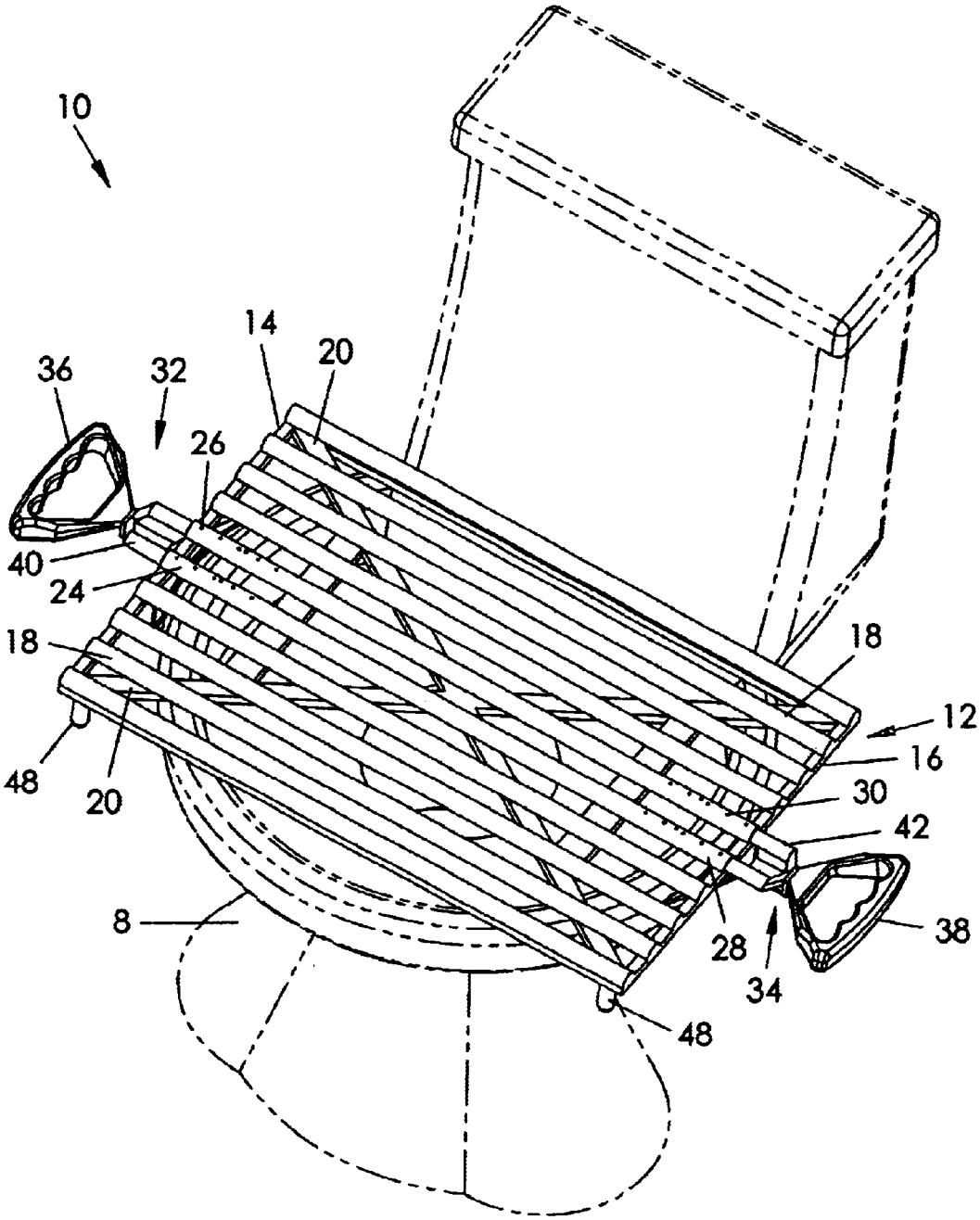
FIG. 1 is a perspective view of an indoor flower watering rack according to one embodiment of the present invention in use mounted atop a toilet bowl rim.
Figure 2:
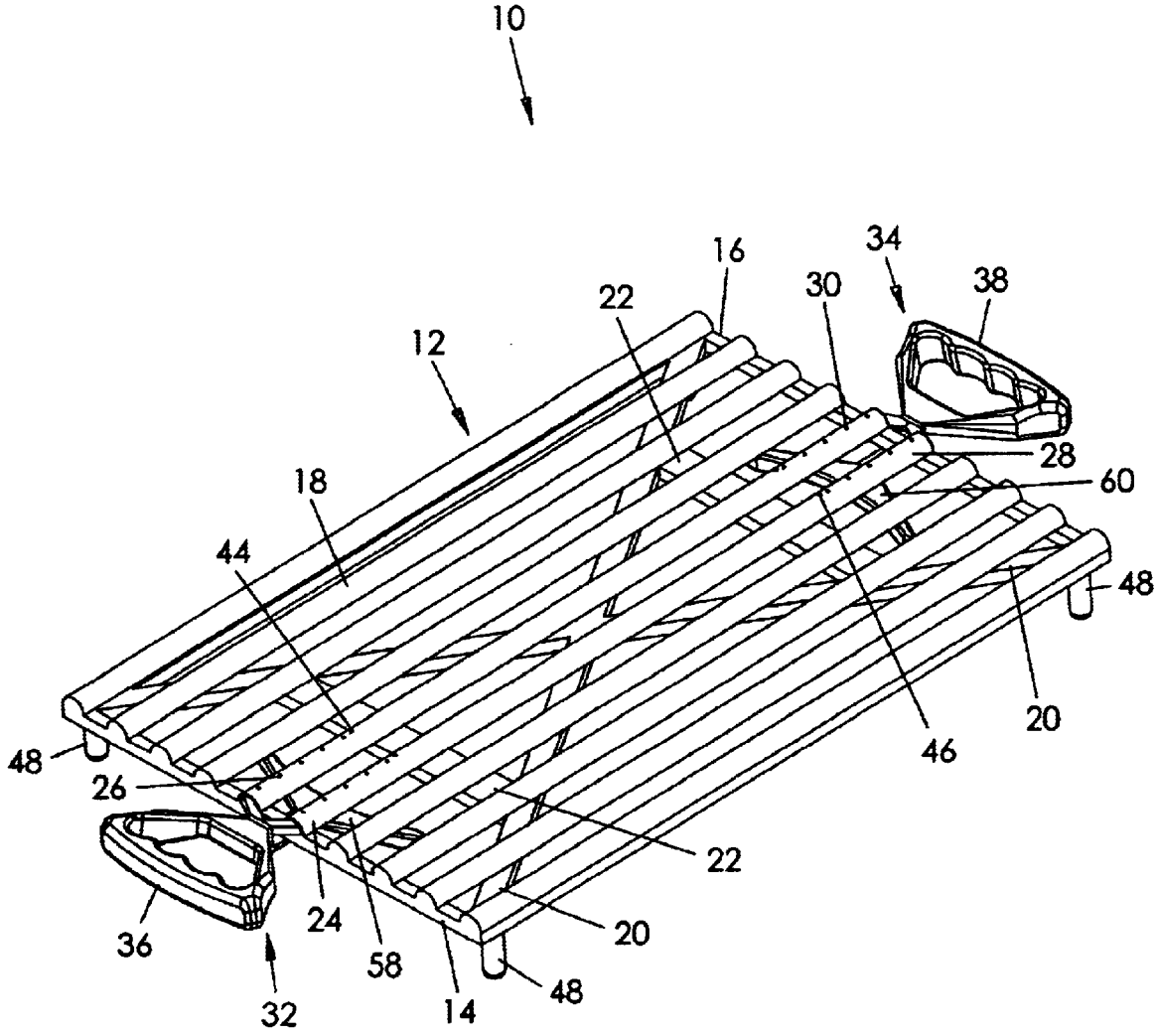
FIG. 2 is another perspective view of the watering rack as in FIG. 1 removed from the toilet and with the handle and clamp members in a clamped configuration.
Figure 4:
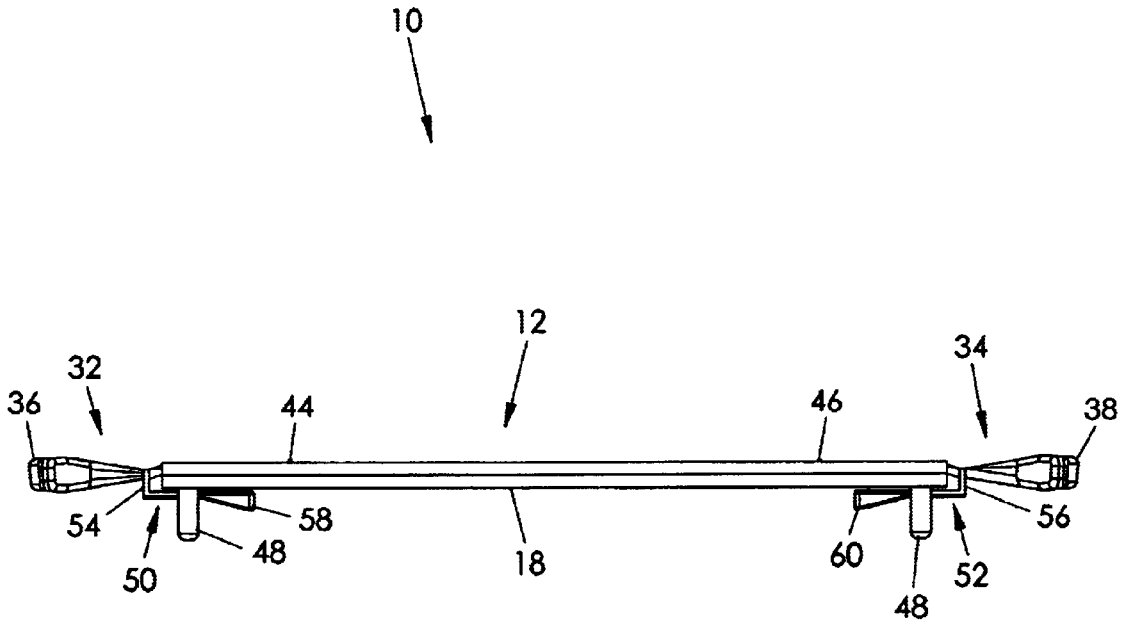
FIG. 4 is a front view of the watering rack as in FIG. 2.
Figure 5:
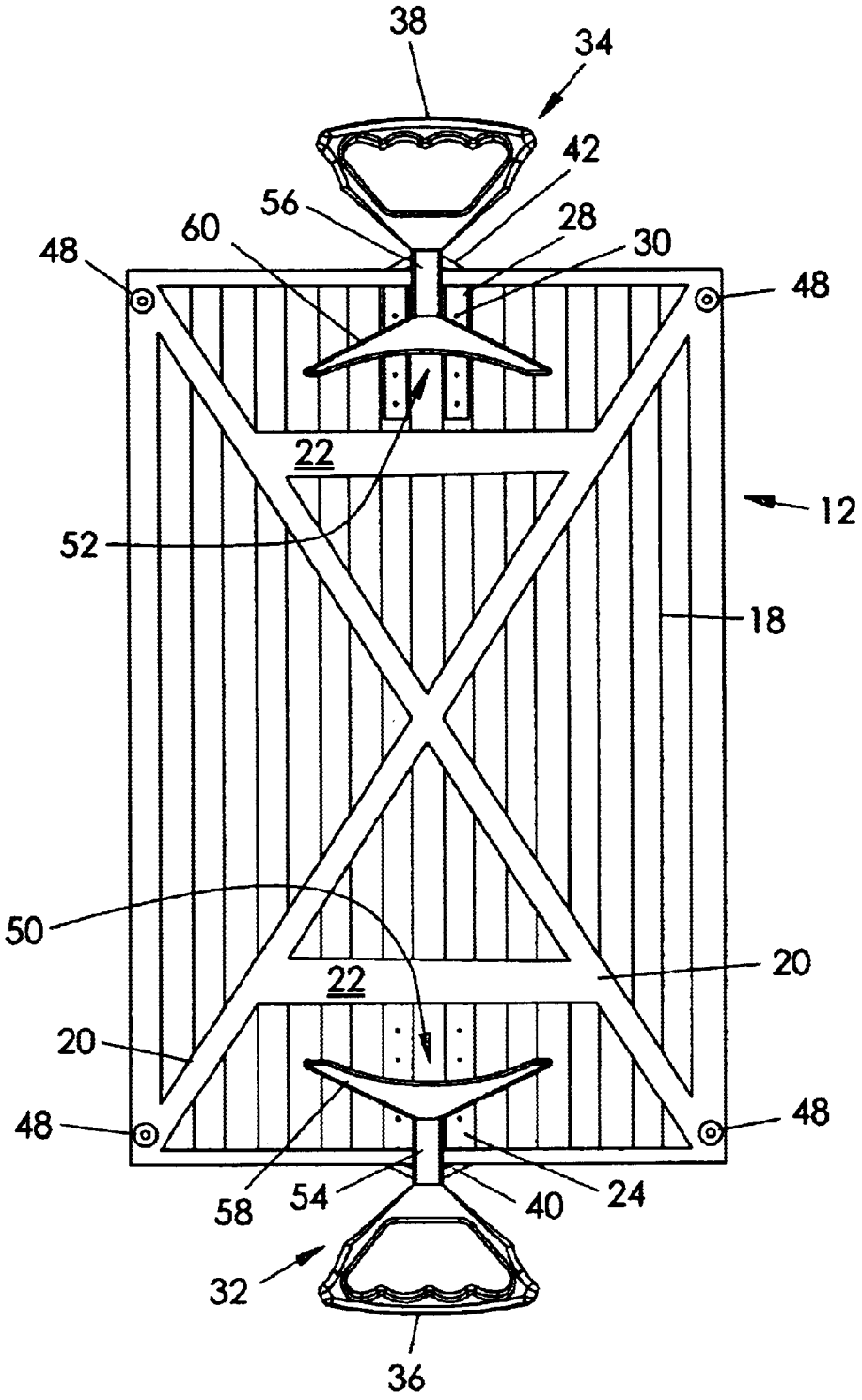
FIG. 5 is a bottom view of the watering rack as in FIG. 2.

An indoor flower watering rack according to the present invention will now be described in detail with reference to FIGS. 1 through 6 of the accompanying drawings. An indoor flower watering rack 10 according to one embodiment of the present invention is shown in FIGS. 1 through 5 and includes a support rack 12. The support rack 12 includes first 14 and second 16 frame members that are laterally spaced apart from and parallel to each other (FIG. 5) although other frame member configurations would also be suitable. A plurality of laterally spaced apart elongate support members 18 extend longitudinally between the frame members 14, 16 (FIG. 2). The support members 18 are spaced apart so as to allow water drainage therebetween. Preferably, the support rack 12 also includes a pair of elongate auxiliary frame members 20 extending between opposed ends of the first 14 and second 16 frame members in a generally X-shaped configuration (FIG. 5). Additional struts 22 may extend between the auxiliary frame members 20 for additional strength and support. The framework described herein enables the support rack 12 to support a substantial amount of weight, such as large potted plants or multiple potted plants. It is understood that the entire support rack 12 may be integrally constructed of a durable plastic material such as polyethylene, polypropylene or polycarbonate. In addition, the bottom surface of the frame members, auxiliary frame members, and support members may include a rubber layer or coating for providing a slip-resistance surface, whereby to inhibit slippage when mounted atop a toilet rim.

Each support member 18 includes a hemispherical configuration although tubular or other configurations would also work so long as a potted plant may be securely rested thereon. A pair of the support members 18 include hollow configurations defining opposed first 24 and second 28 sleeve portions (FIG. 3) although the invention would also work so long as at least one support member defines opposed sleeve portions. The sleeve portions are open-ended.

The watering rack 10 includes first 32 and second 34 handle members having first 36 and second 38 user-graspable handles and first 40 and second 42 arms, respectively. Preferably, the first 40 and second 42 arms each include a pair of parallel arm portions (FIGS. 2 and 3) although it would also be suitable for each handle member to have a single arm portion. The arm portions are slidably received in respective first 24 and second 28 sleeve portions and are movable in inward and outward directions therein. In other words, the arms 40, 42 are movable along an imaginary longitudinal axis extending through and between the sleeve portions perpendicular to the first 14 and second 16 frame members of the support rack 12.

The sleeve portions define respective pluralities of longitudinally spaced apart apertures 26, 30. A first 44 and second 46 pair of spring-loaded pins are attached to free ends of respective first 40 and second 42 arms such that said pins automatically spring into engagement with user-selected pairs of apertures 26, 30. In other words, the handle arms 40, 42 may be inwardly or outwardly adjusted when a user depresses a pair of pins. When the longitudinal adjustment is complete, the user may release the pins to lockingly engage respective apertures. Of course, other fasteners may be utilized, such as bolts or pins extending through corresponding sleeve and arm apertures.

Figure 3:
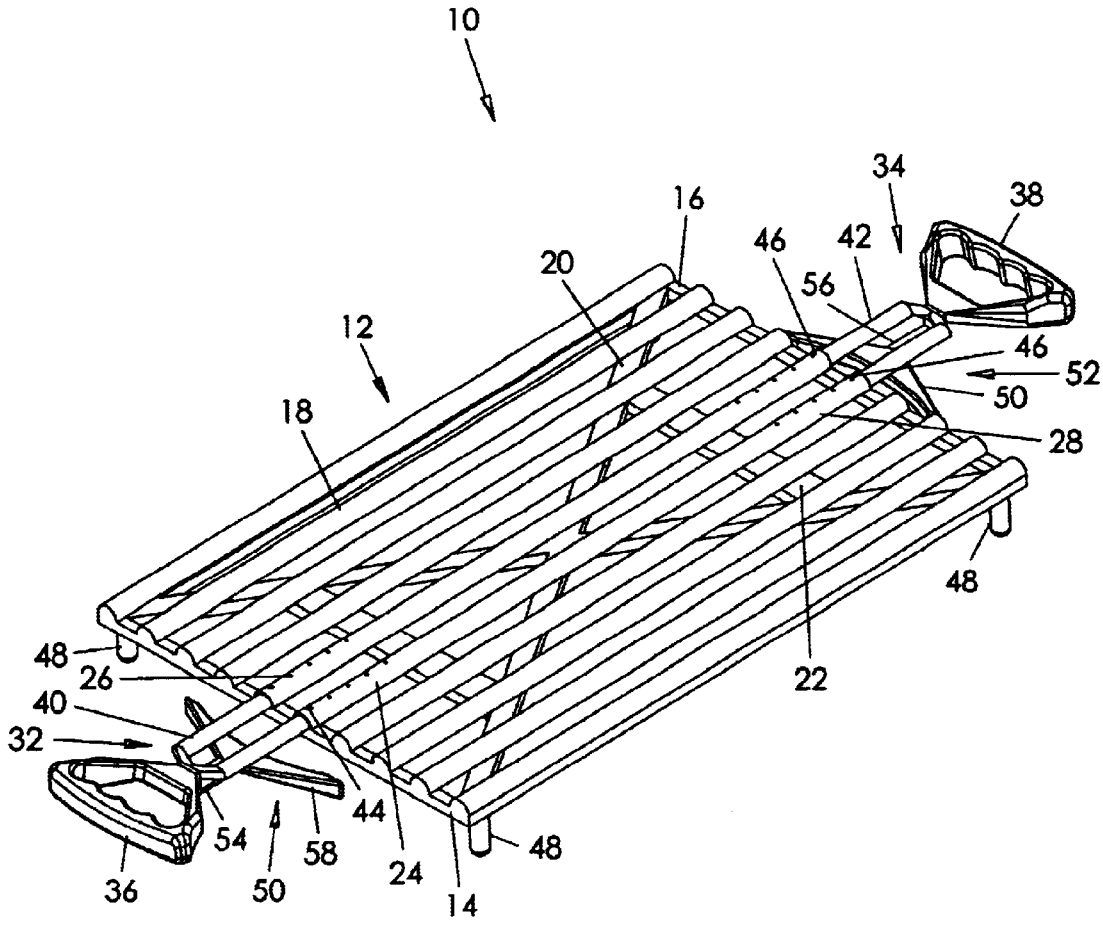
FIG. 3 is a perspective view of the watering rack as in FIG. 3 in a released configuration.

First 50 and second 52 clamp assemblies are fixedly attached to respective arms of the first 32 and second 34 handle members (FIG. 3). More particularly, the first 50 and second 52 clamp assemblies include respective L-shaped brackets 54, 56 depending from respective handles 36, 38 with respective first 58 and second 60 clamp members fixedly attached to terminal ends of respective brackets 54, 56 (FIG. 4). Each clamp member presents an annular configuration that is complementary to the outer surface of a toilet bowl rim. Further, the clamp members 58, 60 are constructed of a semi-flexible material such that they may be tightly pressed against opposed portions of the outer surface of the toilet rim in a clamping configuration. Although a pair of clamp members positioned on opposed sides of the support rack 12 is preferred, it is understood that both clamp members could depend from a single handle member in a spring-clamp arrangement for clamping the support rack to only one portion of the toilet rim.

The indoor flower watering rack 10 further includes a plurality of legs 48 depending from ends of said first 14 and second 16 frame members. Preferably, these legs 48 are fixedly attached to the frame members although they may alternatively be removably attached, such as in a snap-fit relationship or a threaded coupling, as shown with reference number 48*a* in FIG. 6. Removal of the legs 48 would be desirable where use upon a toilet is most frequently preferred rather than placement upon a support surface. The legs 48 are positioned at the corners of the support rack 12 such that the support rack 12 may be supported upon a support surface in a stable manner.

In use, a user may carry the indoor flower watering rack 10 to a desired location by grasping and lifting the first 36 and second 38 handles. The rack 10 may be positioned in a bathtub and supported therein upon its legs 48. Or, the support rack 12 may be rested atop the rim of a toilet bowl 8 (FIG. 1). The user may then depress respective pairs 44, 46 of spring-loaded pins to facilitate inward movement of the handle members 32, 34. Correspondingly, this adjustment causes the clamp members 58, 60 to bear against opposed portions of the toilet rim in a tight clamping relationship. Once positioned, one or more potted houseplants may be situated upon the support rack 12 and watered. Any excess water or dirt drains through the spaced apart support members 18 into the tub drain or toilet bowl for easy disposal thereof. The rack 10 may be removed by again depressing respective pins and moving the handle members 32, 34 in outward directions.

Figure 6:
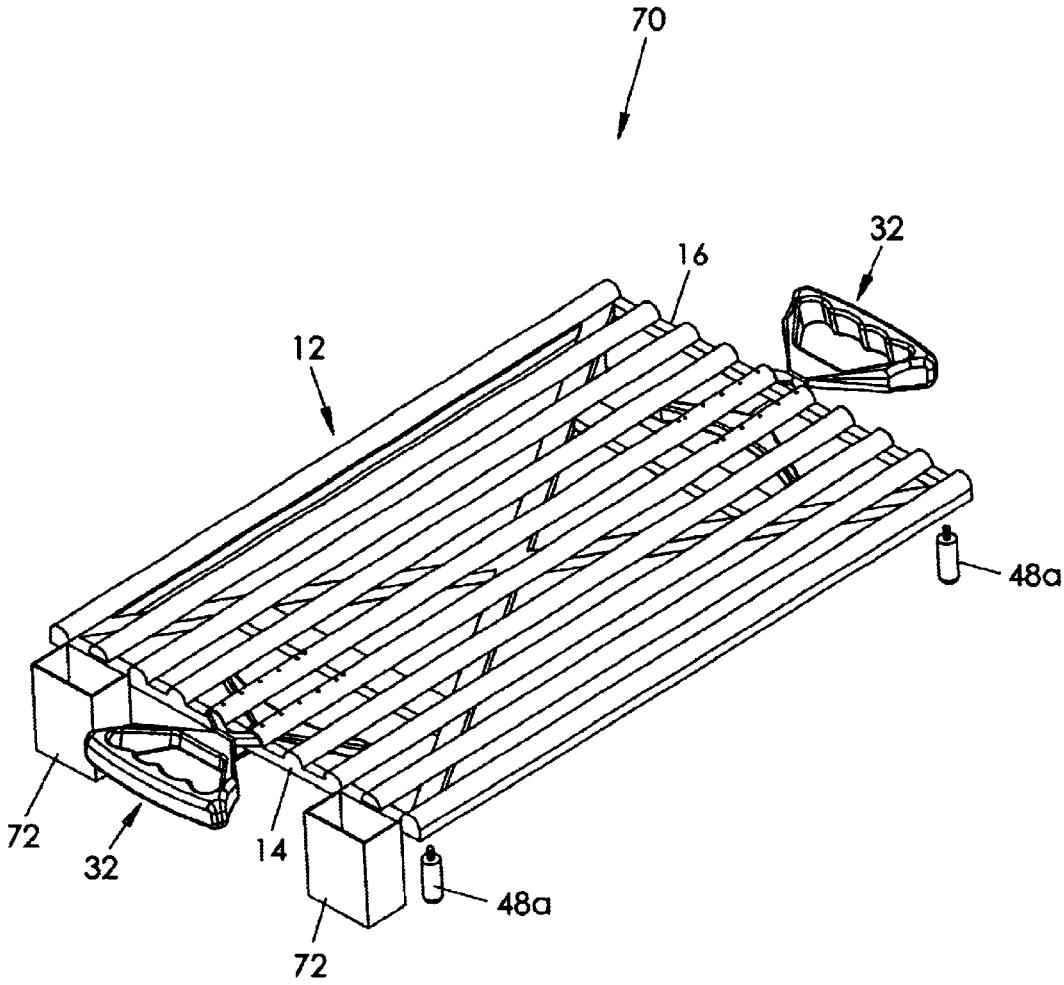
FIG. 6 is a perspective view of an indoor flower watering rack according to another embodiment of the present invention.

Another embodiment of the indoor flower watering rack 70 is shown in FIG. 6 and includes a construction substantially similar to a construction of the embodiment described above except as specifically noted below. The watering rack 70 according to this embodiment includes at least one accessory box 72 mounted to a support rack frame member 14. Each accessory box 72 includes a bottom and upstanding side walls and defines an open top through which gardening accessories may be inserted. Having an accessory box 72 mounted to the support rack 12 allows gardening tools to be conveniently accessible while watering houseplants.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An indoor flower watering rack, comprising:

a support rack having first and second spaced apart frame members and a plurality of laterally spaced apart support members extending longitudinally between said first and second frame members;

first means coupled to said support rack adjacent said first frame member for releasably clamping said support rack to a first portion of a toilet rim, said first clamping means including a first clamp member coupled to said support rack adjacent said first frame member for movement in opposed directions along an imaginary longitudinal axis perpendicular to said first frame member; and second means coupled to said support rack adjacent said second frame member for releasably clamping said support rack to a second portion of said toilet rim, said second clamping means including a second clamp member coupled to said support rack adjacent said second frame member for movement in opposed directions relative to said second frame member and along said imaginary longitudinal axis.

2. The watering rack as in claim 1 wherein each support member includes a hemispherical configuration and is mounted to a top surface of respective first and second frame members.

3. The watering rack as in claim 1 wherein:

at least one support member includes a hollow configuration defining a sleeve;

said first and second clamp members include first and second arms, respectively, that are slidable within opposed end portions of said sleeve; and means for holding said first and second arms in user-selectable configurations relative to said opposed end portions of said sleeve.

4. The watering rack as in claim 1 further comprising first and second handles coupled to said first and second clamp members, respectively.

5. The watering rack as in claim 1 wherein said first and second clamp members include respective annular configurations for contiguous placement against an outer surface of said toilet rim.

6. The watering rack as in claim 1 further comprising a plurality of legs depending from said support rack for supporting said support rack upon a support surface.

7. The watering rack as in claim 1 further comprising an accessory box fixedly attached to said first frame member, said box defining an open top for receiving articles into said box.

8. An indoor flower watering rack, comprising:

a support rack having first and second spaced apart fine members and a plurality of laterally spaced apart support members extending longitudinally between said first and second frame members;

wherein one of said support members includes a hollow configuration defining opposed first and second sleeve portions;

a first handle member having a first arm slidable in said first sleeve portion;

a second handle member having a second arm slidable in said second sleeve portion;

means for holding said first and second arms in user-selectable configurations relative to respective first and second sleeve portions; and a plurality of legs depending from said first and second frame members for supporting said support rack upon a support surface.

9. The watering rack as in claim 8 further comprising a pair of auxiliary frame members extending between opposed ends of said first and second frame members in a generally "X" shaped configuration.

10. The watering rack as in claim 8 further comprising:

a first clamp member coupled to said first arm of said first handle member and positioned beneath said support rack, said first clamp member being movable in opposed directions according to corresponding movements of said first handle member;

a second clamp member coupled to said second arm of said second handle member and positioned beneath said support rack, said second clamp member being movable in opposed directions according to corresponding movements of said second handle member;

whereby a toilet rim is sandwiched between said first and second clamp members when said support rack is positioned atop said toilet rim and said first and second handle members are slidably moved toward one another.

11. The watering rack as in claim 10 wherein said first and second clamp members include respective annular configurations for contiguous placement against an outer surface of said toilet rim.

12. The watering rack as in claim 8 wherein each support member includes a hemispherical configuration.

13. The watering rack as in claim 8 further comprising an accessory box fixedly attached to said first frame member, said box defining an open top for receiving articles into said box.

14. An indoor flower watering rack, comprising:

a support rack having first and second spaced apart frame members and a plurality of laterally spaced apart support members extending longitudinally between said first and second frame members;

wherein one of said support members includes a hollow configuration defining opposed first and second sleeve portions;

a first handle member having a first arm slidable in said first sleeve portion;

a second handle member having a second arm slidable in said second sleeve portion;

means for holding said first and second arms in user-selectable configurations relative to respective first and second sleeve portions;

a first clamp member coupled to said first arm of said first handle member and positioned beneath said support rack, said first clamp member being movable in opposed directions according to corresponding movements of said first handle member;

a second clamp member coupled to said second arm of said second handle member and positioned beneath said support rack, said second clamp member being movable in opposed directions according to corresponding movements of said second handle member; and whereby a toilet rim is sandwiched between said first and second clamp members when said support rack is positioned atop said toilet rim and said first and second handle members are slidably moved toward one another.

15. The watering rack as in claim 14 wherein said first and second clamp members include respective annular configurations for contiguous placement against an outer surface of said toilet rim.

16. The watering rack as in claim 14 further comprising a plurality of legs depending from said first and second frame members for supporting said support rack upon a support surface.

17. The watering rack as in claim 14 further comprising an accessory box fixedly attached to said first frame member, said box defining an open top for receiving articles into said box.

* * * * *